United States Patent [19]

Dickens

[11] 4,300,697

[45] Nov. 17, 1981

[54] WIRE CONTAINER FOR RETURNABLE BEVERAGE CANS

[76] Inventor: Robert E. Dickens, 910 Bridgestone Dr., Rochester, Mich. 48063

[21] Appl. No.: 80,237

[22] Filed: Oct. 1, 1979

[51] Int. Cl.[3] ..... B65D 6/08; B65D 6/40

[52] U.S. Cl. ..... 220/19; 220/22; 220/334; 206/202; 294/159

[58] Field of Search ..... 220/19, 22, 334; 206/202; 224/45 A

[56] References Cited

U.S. PATENT DOCUMENTS

| | | | |
|---|---|---|---|
| 1,129,011 | 2/1915 | Pyle | 220/19 |
| 1,231,022 | 6/1917 | Headley | 220/19 |
| 2,239,482 | 4/1941 | Cocks | 220/19 |
| 2,344,507 | 3/1944 | Gookin | 220/334 |
| 2,529,267 | 11/1950 | Sloane | 220/19 |
| 2,533,524 | 12/1950 | Snider | 220/19 |
| 2,697,540 | 12/1951 | Malliaris | 206/202 |

FOREIGN PATENT DOCUMENTS

| | | | |
|---|---|---|---|
| 824798 | 11/1937 | France | 220/19 |

*Primary Examiner*—George E. Lowrance
*Attorney, Agent, or Firm*—Basile, Weintraub & Hanlon

[57] ABSTRACT

A wire container for returnable beverage cans is disclosed. The wire container of the present invention is formed by joining together a plurality of spaced apart horizontal rectangular wire frame members utilizing a plurality of upright rods abutting the frame members around the periphery thereof. A bottom member is hinged to the lower most frame member and is biased to a closed position by a torsion spring. The wire container is divided into a plurality of equal compartments by a plurality of equally spaced divider members extending transversely between opposed sides of the frame members.

5 Claims, 4 Drawing Figures

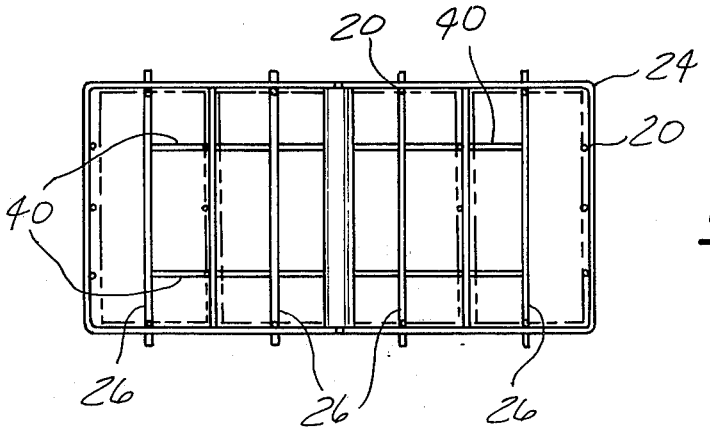
FIG-2
FIG-1
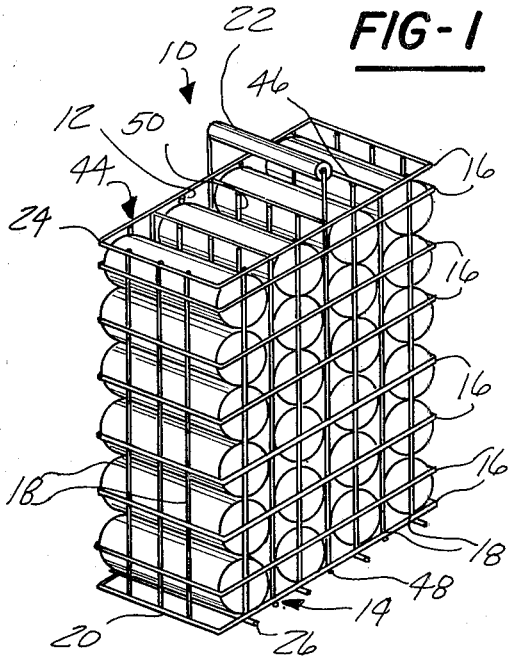
FIG-3
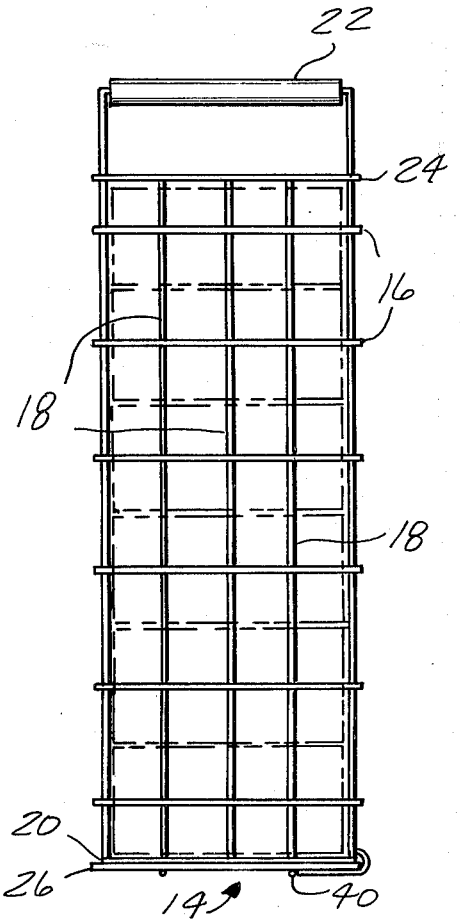
FIG-4
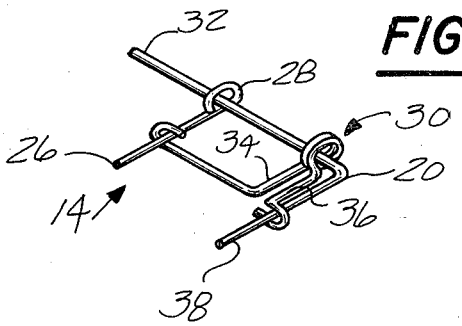

WIRE CONTAINER FOR RETURNABLE BEVERAGE CANS

BACKGROUND OF THE INVENTION

I. Field of the Invention

The present invention relates to the field of containers formed from wire. More specifically the present invention relates to the field of containers made from wire for carrying a plurality of beverage containers. Even more specifically the present invention relates to the field of containers made from wire for carrying returnable beverage cans, the containers having a hinged bottom for simultaneously dumping all of the cans contained therein.

II. Description of the Prior Art

Wire baskets or containers made from wire or rod have long been known.

U.S. Pat. No. 1,443,901 discloses a folding wire crate or container which in a deployed position has a hinged top. This U.S. patent does not disclose the divider or hinged bottom of the present invention.

U.S. Pat. No. 2,695,723 discloses a sectional receptacle structure for cigars or other fragile articles. This U.S. patent does not disclose the hinged bottom of the present invention.

U.S. Pat. No. 3,484,019 discloses a collapsible bottle carrying container made from planar members such as paper board. This U.S. patent is for carrying bottles in an upright position and does not disclose the hinged bottom of the present invention.

U.S. Pat. No. 3,907,150 discloses a rigid container comprising crossing wire rods welded to an angled iron frame. This U.S. patent does not disclose the compartment of the present invention and it does not disclose the hinged bottom of the present invention.

U.S. Pat. No. 3,935,958 discloses a compartmented utensil basket made from wire screens supported by a frame made from rods. This U.S. patent discloses a hinged top and a carrying handle. This U.S. patent does not disclose the hinged bottom of the present invention for quick emptying of the container.

U.S. Pat. No. 2,741,392 discloses a glass washing tray made from wire. This U.S. patent does not disclose the compartment of the present invention for vertically stacking beverage cans and does not disclose the hinged bottom of the present invention.

The above listed U.S. patents constitute the closest prior art known to the applicant and his attorney.

SUMMARY OF THE INVENTION

It is an object of the present invention to provide a container for returnable beverage containers. It is also an object of the present invention to provide a container made from wire for returnable beverage containers. It is a further object of the present invention to provide a container made from wire for returnable beverage cans. It is also an object of the present invention to provide a container made of wire or rod for returnable beverage cans having an open top and a hinged bottom member made from wire or rod wherein the cans contained within the container can be simultaneously dumped.

The wire container for returnable beverage cans of the present invention comprises a wire structure having an open top, a pair of opposed sides, a pair of opposed ends and a wire bottom member. The wire structure is formed from a plurality of parallel spaced apart horizontal rectangular wire frame members joined together by a plurality of up-right rods abutting the frame sides and ends. The wire bottom member is hinged to a lower most frame member and is biased to a closed position by a torsion spring. The container is divided into a plurality of equal compartments by a plurality of equally spaced divider members extending transversely between the opposed sides and vertically between the lower most frame member and an upper most frame member. The bottom member comprises: a plurality of bottom transverse rods extending between and beyond the opposed sides of the lower most frame members; at least one of the transverse rods curving upward and around a side of the lower most frame in an arcuate manner to form a loop defining a hinge. A plurality of longitudinal rods extend between the transverse rods and are abutted and joined thereto to form the bottom member.

A handle for carrying the container extends between the pair of opposed sides of the upper most frame member and is positioned to intersect the length of the opposed sides.

The container of the present invention is divided into a plurality of equal compartments by a plurality of divider members. The divider members comprise an upper transverse rod abutting and adjoined at its end to the opposed sides of the upper most frame member; a lower transverse rod abuts and is adjoined at its ends to the opposed sides of the lower most frame member; and a plurality of up-right divider rods abutting and extending between the upper and lower transverse rods.

For a more complete understanding of the present invention, reference is made to the following detailed description and accompanying drawing.

Other objects, advantages, and applications of the present invention will become apparent to those skilled in the field to which this invention pertains, when the accompanying description of the best modes contemplated for practicing the invention are read in conjunction with the accompanying drawing.

BRIEF DESCRIPTION OF THE DRAWING

In the drawing, like reference numbers refer to like parts throughout the several views, and wherein:

FIG. 1 illustrates a perspective view of the wire container of the present invention;

FIG. 2 illustrates a top view of the wire container of FIG. 1;

FIG. 3 illustrates an end view of the wire container of FIG. 1; and

FIG. 4 illustrates a broken perspective view of the hinge and torsion spring of the present invention.

DESCRIPTION OF THE PREFERRED EMBODIMENTS

Referring now to the drawing and in particular to FIG. 1, there is illustrated at 10 a perspective view of a preferred embodiment of the present invention comprising a wire container for returnable beverage cans. The wire container of the present invention comprises an open top 12 and a wire bottom member 14 which is hinged to the container in a manner which will described more fully hereinbelow.

As shown in FIGS. 1 and 3, the wire container 10 further comprises a plurality of parallel horizontal rectangular wire or rod frame members 16, including a pair of spaced apart opposed sides and a pair of opposed spaced apart ends. The frame members 16 are joined in a spaced apart manner by a plurality of upright rods 18 abutting the frame members 16 around the perimeter thereof. The up-right rods are affixed to the frame members by welding or other suitable means. The bottom member 14 is hinged to a lower most frame member 20 by a hinge which will be described subsequently. A handle 22 extends transversely between the pair of opposed sides of an upper most frame member 24 to provide a means for hand carrying the container.

The bottom member 14 of the container 10 comprises a plurality of bottom transverse rods 26 extending between and beyond the opposed sides of the lower most frame member 20. One end of at least one of the transverse rods 26 is curved upward and around a side of the lower most frame 20 in an arcuate manner forming a loop which defines a hinge 28, as shown in FIG. 4. In a preferred embodiment a hinge is formed on the ends of the outer most rods 26 of the bottom member 14. A torsion spring 30 is looped around an opposed side 32 of the lower most frame member 20 and a pair of radially extending ends 34,36 of the torsion spring 30 extend outward therefrom. The outward extending end 34 is extended transversely a distance and then longitudinally a distance to reach one of the transverse rods 26 where it is looped around the rod to be attached thereto. The radially extending rod 36 extends transversely inward a distance and is then looped around an opposed end 38 of the lower most frame member 20 and is looped around the opposed end 38 to be attached thereto. The torsion spring 30 biases the wire bottom member 14 to a closed position. The plurality of transverse rods 26 are joined together in a spaced apart manner by a plurality of longitudial rods 40, FIG. 2, which abut the transverse rods 26 and are affixed thereto to form the bottom member 14 into an integral structure.

As shown in FIG. 1, the wire container 10 of the present invention is optionally divided into a plurality of equal transverse compartments by a plurality of equally spaced divider members 44 extending transversely between the opposed sides. Each divider member comprises an upper transverse rod 46 abutting and adjoined at its ends to the opposed sides of the upper most frame member 24. A plurality of lower transverse rods 48 abut and are adjoined at their ends to the opposed sides of the lower most frame member 20, and a plurality of upright divider rods 50 abut and extend between the upper transverse rods 46 and the lower transverse rods 48 and are attached thereto at their ends.

In a preferred configuration the wire container has four transverse compartments sized to slidingly accommodate a row of beverage containers with their axes deployed horizontally parallel to the compartment. The wire container has sufficient height to accommodate six beverage containers stacked one on the other and deployed as described hereinabove. The total capacity of the optimum wire container would optionally be twenty-four empty beverage containers.

In a preferred embodiment the container is dipped in a solution of paint, liquid rubber, or liquid plastic and air dried to produce an attractive appearance and color variations. The covering of the wire with paint rubber or plastic also prevents corrosion. The hinge 28 and torsion spring 30 are formed after the covering has been dried.

In use the beverage containers as they are used would be stored in the compartments and laid on their sides to allow drainage. Once the wire container for returnable beverage cans is filled it is easily transported by means of the handle to the retail establishment where a refund is obtained for the deposit placed on the beverage cans. The merchant making the refund, by virtue of the wire construction of the container, is readily able to ascertain the number of cans returned and to identify the brand and value of each container.

There has been described hereinabove a wire container for returnable beverage cans which will facilitate the storage and transportion of returnable beverage cans. The hinged bottom member which is biased to the closed position allows the wire container to be easily opened at the bottom for a speedy dumping of the returned cans once they have been identified and counted.

Having thus described my invention what I claim is:

1. A wire container for returnable beverage cans having an open top and a wire bottom member comprising:

a plurality of parallel, horizontal, rectangular wire frame members having a pair of opposed spaced apart sides and a pair of opposed spaced apart ends, joined in a spaced apart manner by a plurality of upright rods abutting the frame members around the perimeter thereof;

the bottom member hinged to a lowermost frame member;

an opposed central pair of upright rods extending upward past an uppermost frame member then inward to form a handle support, said opposed pair of upright rods defining a marginal edge of a divider member.

2. The container as defined in claim 1 wherein:

the container is divided into equal compartments by a plurality of equally spaced divider members extending transversely between the opposed sides.

3. The container as defined in claim 1 further comprising:

a handle extending between the opposed central pair of upright rods.

4. The container as defined in claim 1 wherein the bottom member comprises:

a plurality of bottom transverse rods extending between the opposed sides of the lowermost frame member;

at least one of the transverse rods curving upward and around a side of the lowermost frame in an arcuate manner forming a loop to define a hinge;

a plurality of longitudinal rods abutting and joined to the transverse rods to form the bottom member;

means for biasing the bottom member against the lowermost frame;

at least one of the bottom transverse rods having an end extending beyond the lowermost frame on a side opposite said hinge; and wherein the biasing means holds the bottom member closed to contain returnable beverage cans and a light downward pressure on the extending end causes the bottom member to swing open dumping the container contents.

5. The container as defined in claim 2 wherein the divider members comprise:

an upper transverse rod abutting and adjoined at its ends to the opposed sides of the uppermost frame member;

a lower transverse rod abutting and adjoined at its ends to the opposed sides of the lowermost frame member; and a plurality of upright divider rods abutting and extending between the upper and lower transverse rods.

* * * * *